US007216415B2

(12) United States Patent
Hentges et al.

(10) Patent No.: US 7,216,415 B2
(45) **Date of Patent: *May 15, 2007**

(54) PALLET SCUFFING APPARATUS

(75) Inventors: Jeff Hentges, Olathe, KS (US); Philip King, Bonner Springs, KS (US); William J. Rehrig, Leawood, KS (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/218,866

(22) Filed: Sep. 2, 2005

(65) Prior Publication Data

US 2006/0002777 A1 Jan. 5, 2006

Related U.S. Application Data

(63) Continuation of application No. 10/465,927, filed on Jan. 15, 2004, now Pat. No. 6,938,321, which is a continuation of application No. PCT/US02/00032, filed on Jan. 2, 2002.

(60) Provisional application No. 60/259,454, filed on Jan. 2, 2001.

(51) Int. Cl.
*B23C 1/04* (2006.01)
*B23C 3/13* (2006.01)
*B65D 19/38* (2006.01)

(52) U.S. Cl. ..... 29/557; 409/145; 409/157; 409/131; 83/867; 407/31; 108/57.28; 144/237; 29/33 K; 29/772

(58) Field of Classification Search ..... 409/131–132, 409/145, 157, 159, 192, 203, 213, 217; 83/866–868; 407/31, 58–59; 72/703; 108/51.11, 57.25, 108/57.28; 144/374, 237; 29/557, 700, 29/33 K, 564.1, 772
See application file for complete search history.

(56) References Cited

U.S. PATENT DOCUMENTS

| | | | | |
|---|---|---|---|---|
| 3,613,605 | A | 10/1971 | Holdredge, Jr. | |
| 3,665,793 | A * | 5/1972 | Lehner | 83/867 |
| 3,850,115 | A | 11/1974 | Mackes | |
| 3,938,818 | A | 2/1976 | Studeny et al. | |
| 3,986,543 | A | 10/1976 | Slayton et al. | |
| 4,051,787 | A | 10/1977 | Nishitani et al. | |
| 4,137,956 | A | 2/1979 | Toberg | |
| 4,836,254 | A | 6/1989 | Ruddick | |
| 6,006,677 | A | 12/1999 | Apps et al. | |
| 6,938,321 | B2 * | 9/2005 | Hentges et al. | 29/557 |

* cited by examiner

*Primary Examiner*—Erica Cadugan

(57) ABSTRACT

A scuffing device (30) arranged to impart texture to a plastic pallet surface (12) having a plurality of cutting members (34) axially aligned and mounted adjacent each other, the cutting members (34) having radial toothed edges for cutting into and imparting texture to the plastic pallet surface upon rotating engagement therewith. The device further having a shaft upon which the cutting members are mounted for providing rotational movement to the cutting members.

10 Claims, 4 Drawing Sheets

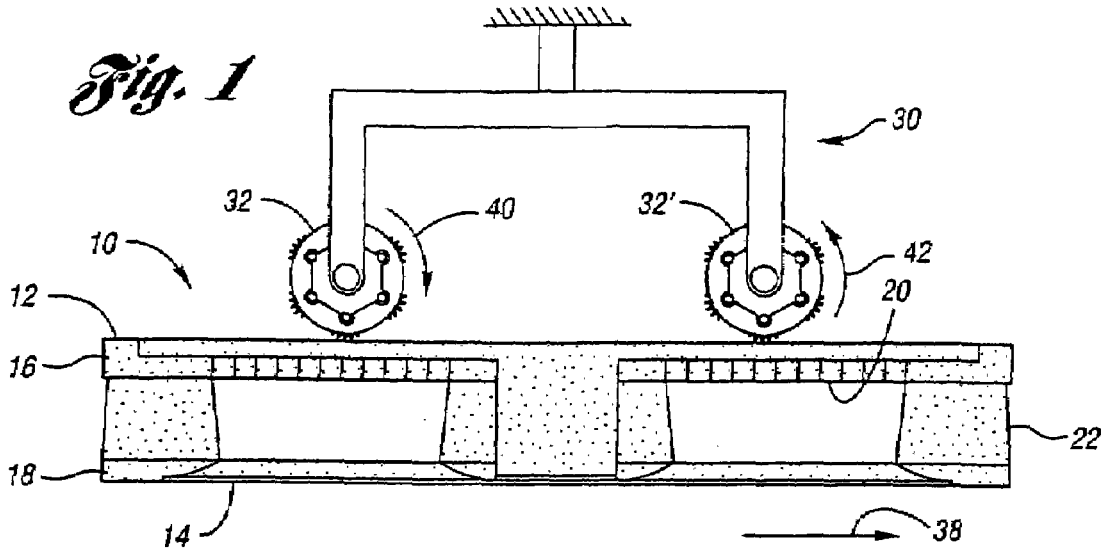
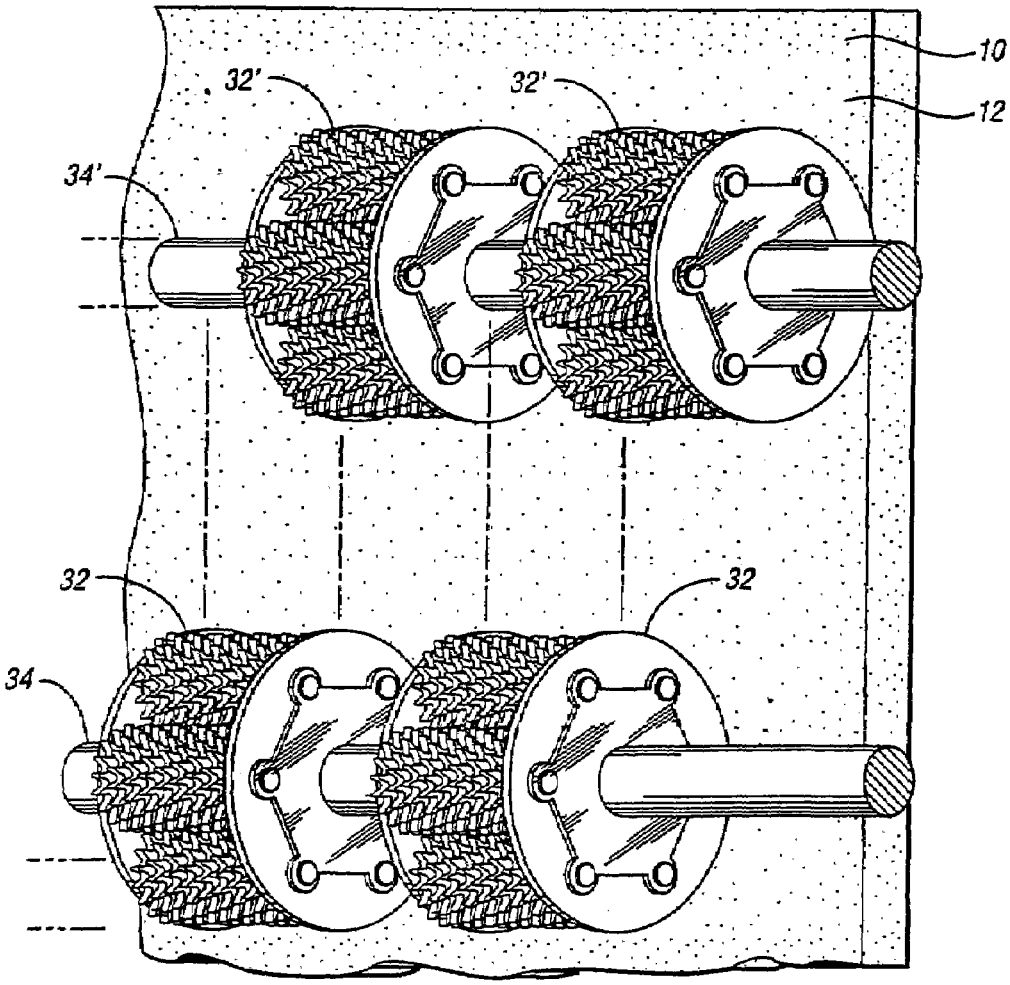
Fig. 2

PALLET SCUFFING APPARATUS

CROSS-REFERENCE TO RELATED APPLICATIONS

This application is a continuation of U.S. application Ser. No. 10/465,927, filed Jan. 15, 2004, now U.S. Pat. No. 6,938,321, which is a continuation of International Application No. PCT/US02/00032, filed Jan. 2, 2002, which, in turn, claims the benefit of U.S. provisional application Ser. No. 60/259,454 filed, Jan. 2, 2001.

BACKGROUND OF THE INVENTION

1. Field of the Invention

This invention relates to an apparatus for scuffing and for providing a slip-resistant surface to a plastic pallet which supports freight, goods, or other materials, to a process for preparing a slip resistant surface, and to plastic pallets thus prepared.

2. Background Art

Plastic pallets may have surfaces which tend to be slippery as a result of the material and molding process. Accordingly, measures may be taken to prevent loads from possibly sliding off the pallet, as well as to keep the stacked pallets from sliding off one another, and further, to keep the pallet from sliding off the forks of the fork lift or a lift track. Common anti-slip measures for pallets involve the use of anti-slip coatings or rubber inserts, such as pads or grommets, placed in strategic locations. Examples are shown in FIGS. 20–25 of U.S. Pat. No. 4,051,787. One drawback of these aforementioned anti-slip measures is that they require the installation of additional parts or materials to a finished pallet and thus required increased material and labor cost. Further, anti-slip coatings can wear away, and inserts can work loose and fall off during use, rendering them ineffective.

Another pallet scuffing technique is disclosed in U.S. Pat. No. 6,006,677, which discloses creating a multi-directional scuffing pattern by brushing the pallet surface with at least one cup-shaped wire brush. While this technique may be effective, a wire brush may not provide the desired level of slip resistance and scuffing desired in many industrial and heavy use applications.

Consequently, there is a need for a pallet scuffing apparatus and technique which provides anti-slip and anti-skid properties to plastic pallets. This apparatus and method should produce textures which do not easily wear away, work loose, or fall off during use.

SUMMARY OF THE INVENTION

An object according to the present invention is to provide a plastic pallet that has sufficient anti-slip and anti-skid features in the areas that provide support to the load, contact the fork of a forklift, as well as the areas which may contact the ground or other pallets in a stacked orientation.

Another object according to the present invention is to provide a plastic pallet wherein the anti-slip feature will not work loose or wear away, but instead is integral with the pallet.

In keeping with the above goals and objects according to the present invention, provided is an improved plastic pallet having a load bearing surface with an improved slip resistant, scuffed texture formed integrally therein. The pallet may also include a bottom surface and a fork contacting region which also include a slip resistant, scuffed texture. In one embodiment, the plastic pallet includes an upper deck and a lower deck, the upper deck having a top surface and the lower deck having a bottom surface. Thus, the top surface defines the load contacting surface, and the bottom surface defines the lower contact surface. The upper deck may also include a bottom surface which defines the fork contacting region and which also includes the slip resistant, scuffed texture. The scuffed texture may be formed on the pallet in a unilateral direction or in a multi-directional pattern. A preferred method of defining the scuffed texture on the pallet is by applying a surface preparation tool having multiple cutters.

The objects, features, and advantages of the present invention are readily apparent from the following detailed description of the best modes for carrying out the invention when taken in connection with the accompanying drawings wherein like reference numerals correspond to like components.

BRIEF DESCRIPTION OF THE DRAWINGS

FIG. 1 is a side view of the apparatus according to the present invention as applied to a pallet surface;

FIG. 2 is a perspective view of the cutter bundles and spindles of the apparatus according to the present invention;

DETAILED DESCRIPTION OF THE PREFERRED EMBODIMENT(S)

Figure 3:
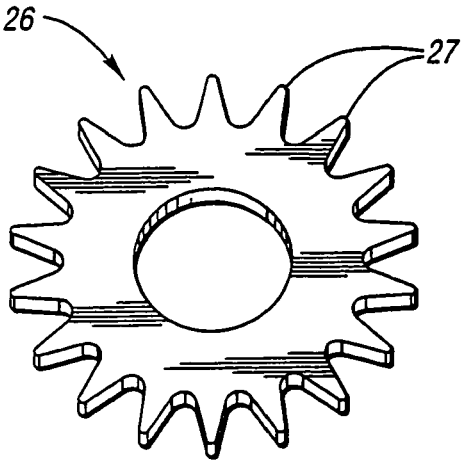
FIG. 3 is a perspective view of a cutting disk from the cutter bundles according to the present invention.

A pallet 10 is provided according to the present invention. Pallet 10 includes an upper surface 12 and a lower surface 14. In one embodiment, the pallet includes an upper deck 16 which includes upper surface 12, and a lower deck 18 which includes bottom surface 14. Upper surface 12 is typically the load bearing and load contacting surface, while bottom surface 14 is the pallet support surface, and generally contacts the ground, floor or other pallets when positioned in a stacked orientation.

Pallet 10 is preferably injection molded and formed of from a thermoplastic material, such as high density polyethylene or polypropylene. The material used to form pallet 10 may have a rather slippery surface just after molding and when the pallet is new. This slippery surface is undesirable in certain areas, such as the top surface 12 of upper deck 16; the bottom surface 14 of lower deck 18; and also the lower surface 20 of upper deck 16, and the areas between the columns or supports 22, these being the areas which are adapted to rest on the forks of a forklift when in use.

In accordance with the teachings of the present invention, in order to achieve the desired anti-slip and scuffing properties, a pallet scuffing apparatus 30 is applied to the desired surfaces (12, 14, 20) of pallet 10. Apparatus 30 includes at least one and preferably a plurality of cutter bundles 32, each of which is fixedly mounted to a spindle 34 to provide rotational movement to the cutter bundles 32 (See FIGS. 6, 7 and 8). While upper surface 12 and lower surface 14 may be treated to this scuffing technique at any time, it is contemplated that the fork contacting region 20 is scuffed before the upper and lower decks 16, 18 are joined together.

The cutter bundles 32 are of the type manufactured by Aurand Manufacturing and Equipment Company, Inc. located in Cincinnati, Ohio, and sold as part of cutting tools bearing Model Nos. M5-1/M5-1E, and M5-2/M5-2E. The cutter bundles 32 themselves may be of the type bearing Model No. 90M. Such cutter bundles 32 in association with the cutting tools are used to remove paint, rust, and scale from wrought iron, large pipes, tanks and valves, beams and girders, and for scoring concrete. Accordingly, while such cutter bundles 32 have been used to remove coatings from typically metallic surfaces, the teachings according to the present invention apply the cutter bundles 32 to various surfaces 12, 14, 20 of a plastic pallet 10 in order to abrade the surfaces and provide an improved anti-skid and anti-slip scuffing surface. The cutter bundles 32 are typically formed of high quality steel, and under some circumstances, it may be necessary to apply a cooling liquid, such as water, to the cutter bundles during operation. Particularly, the cutter bundles 32 include a plurality of bundled serrated disks 26 (see a type of individual disk 26 in FIG. 3) fixedly mounted adjacent to each other.

Figure 4:
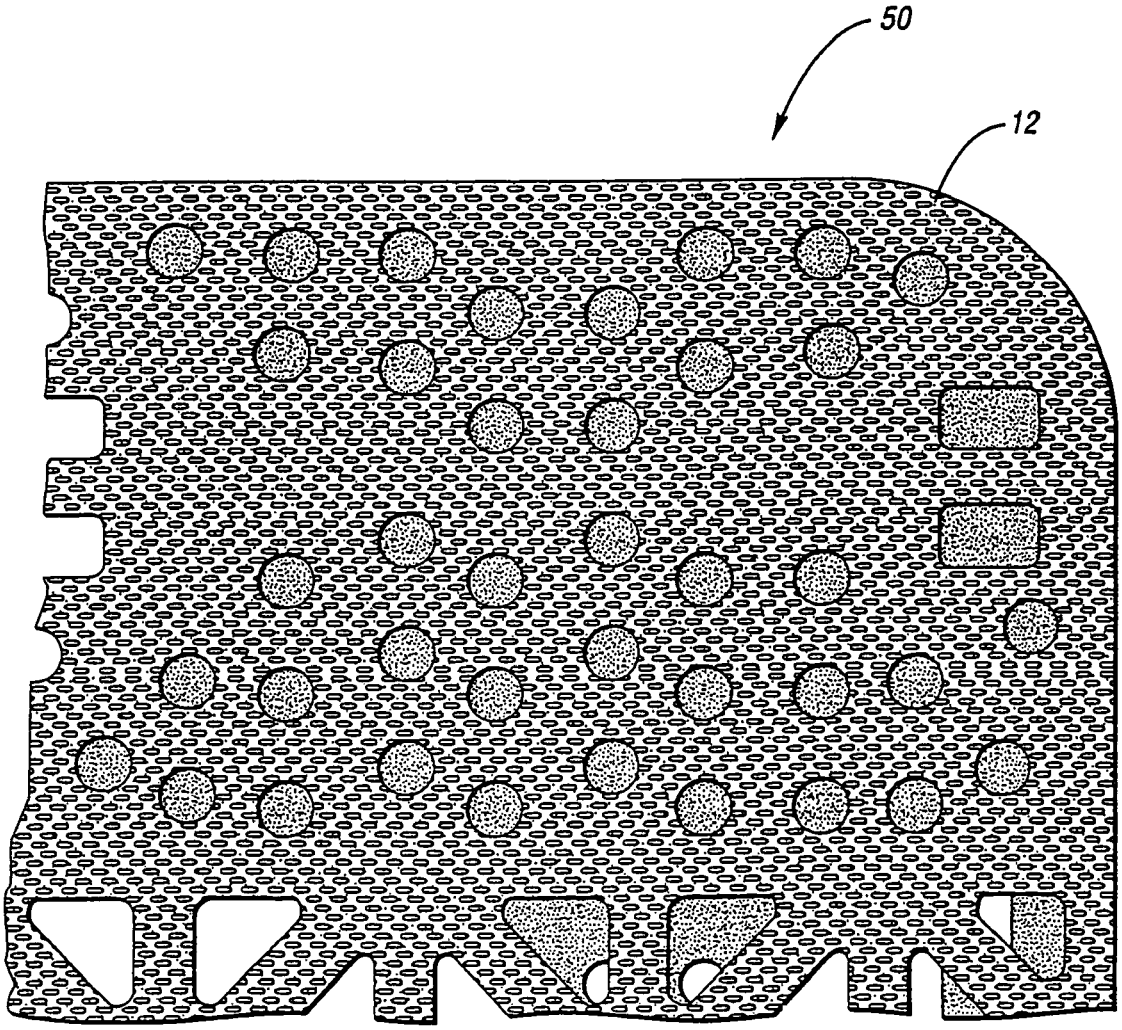
FIGS. 4, 5, and 6 are views of a plastic pallet sections to which the apparatus disclosed herein has been applied to a surface thereof.
Figure 5:
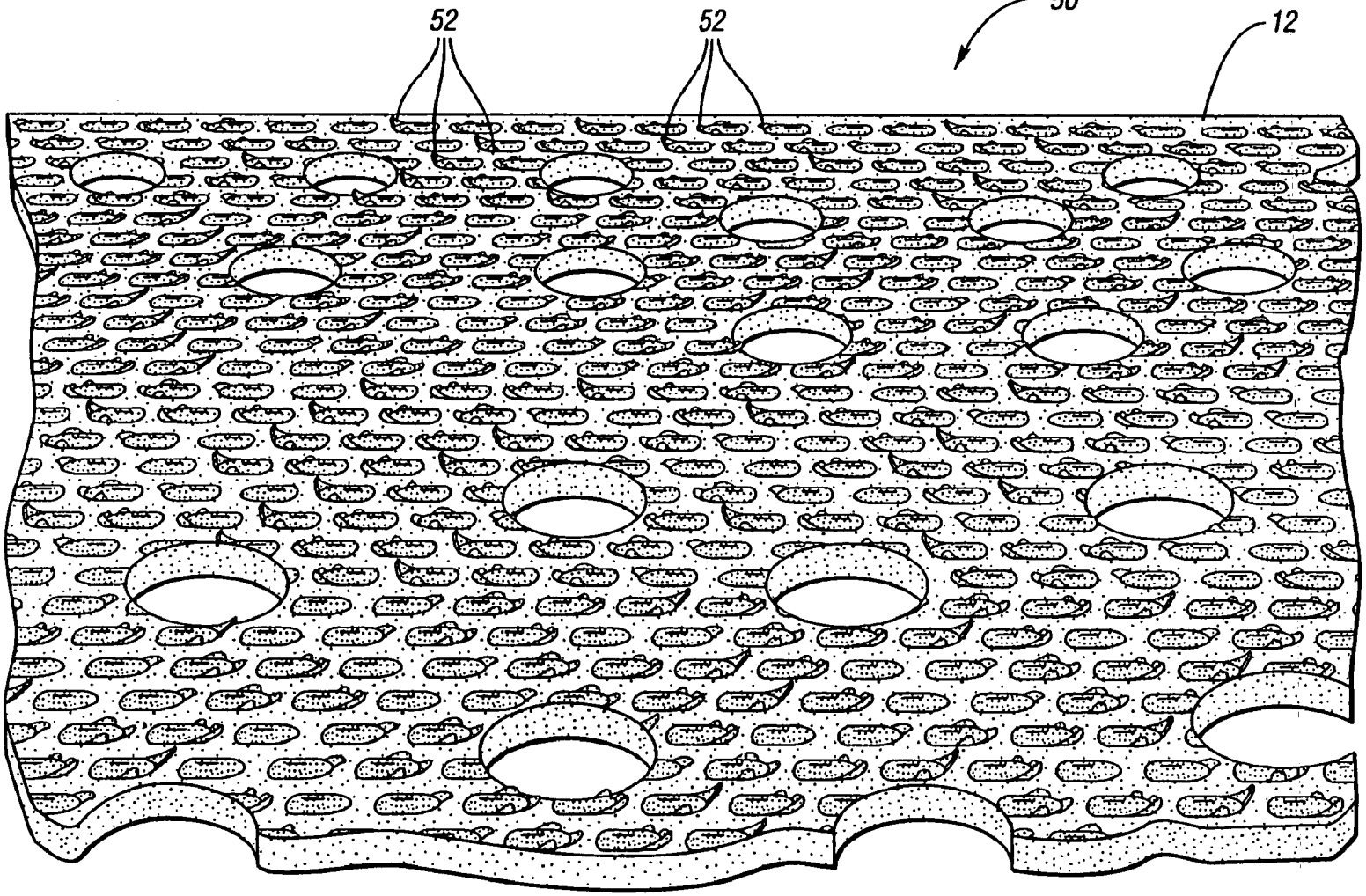

FIGS. 4 and 5 illustrate a corner portion 50 of a plastic pallet 10 to which the apparatus 30 having cutter bundles 32 according to the present invention have been applied. As illustrated in FIGS. 1 and 4, the cutter bundles 32 perform a shearing action against the pallet surface, thereby causing the teeth 27 to scrape or gouge the pallet surface, shaving the appropriate surface of the pallet 10 in order to lift up various portions of plastic material. This shaving creates a plurality of relatively small plastic peels 52, as shown in FIG. 5 much of which remain attached to the pallet 10, resembling a napped surface. This provides a desired scuffed, anti-slip surface not provided by those techniques and devices of the prior art. Note that some of the plastic peels may become separated from the pallet during the scuffing process, thereby defining an improved roughened plastic surface.

Figure 6:
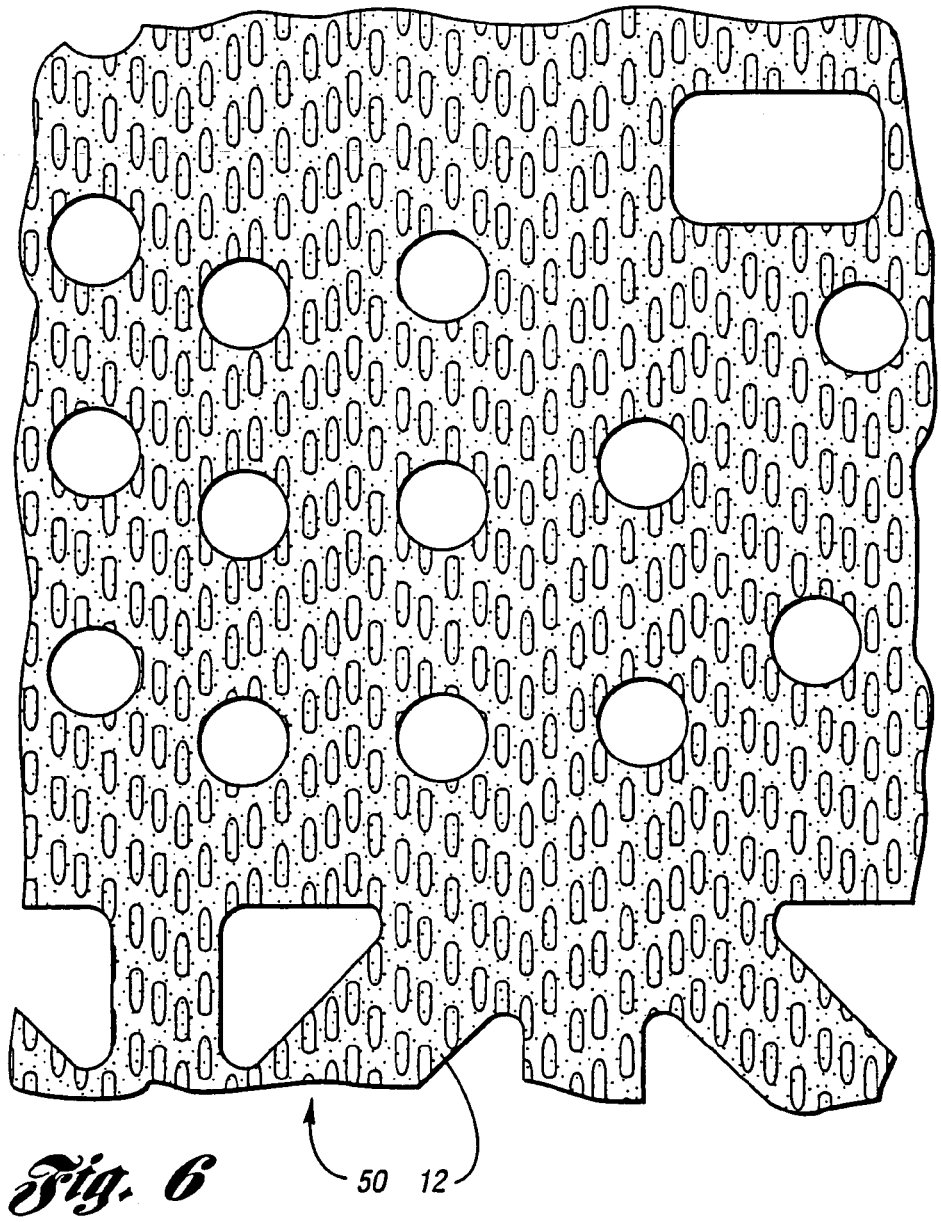
Figure 7:
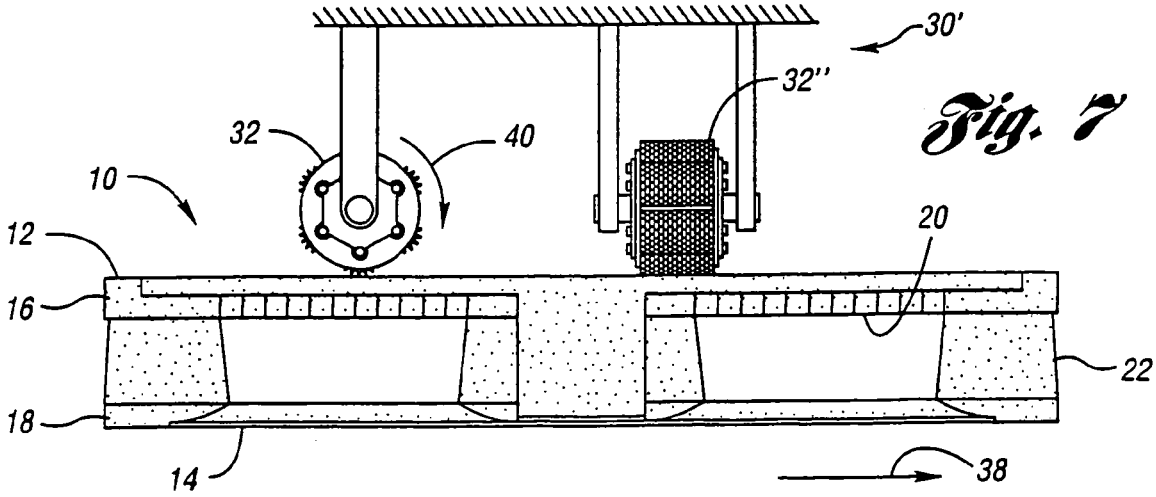
FIG. 7 is a side view of an alternative apparatus according to the present invention as applied to a pallet surface.

FIG. 6 illustrates an additional alternative and enlarged view of the corner portion 50 of plastic pallet 10 to which the apparatus 30 having cutter bundles 32 according to the present invention have been applied.

As shown in FIGS. 1 and 2, the cutter bundles 32 may be mounted to an automated apparatus fixture 30 for treating pallet surfaces, for example, on an automated line after molding and optionally cooling of the pallet. In this embodiment, the apparatus 30 includes a plurality of cutter shafts 34 oriented generally parallel to each other and spaced apart. The cutter bundles 30 are fixedly mounted to the cutter shafts 34. The shafts 34 rotate at a speed appropriate to the desired application. The shafts 34 may be driven with a single power source, and may also include a gearbox to modify the speed of rotation. As shown in the simplified schematic illustration of FIG. 1, as the pallet 10 moves along the line as designated by arrow 38, a first spindle 34 rotates cutter bundles 32 clockwise (in the direction of arrow 40), while a second spindle 34' rotates cutter bundles 32' counter-clockwise (in the direction of arrow 42), such that the teeth 27 of the serrated disks 26 cut into the pallet surfaces in order to define the scuffed surface. Apparatus 30 may also include a depth shoe to limit the depth into the pallet surface that cutter bundles 32 shave, which by example and not limitation may be a cutting depth of 1.0 mm. As shown in FIG. 2, it is contemplated that the cutter bundles 32 of one shaft 34 are oriented in an offset manner from the cutter bundles 32' of the other shaft 34', such that adjacent sections of the pallet have a scuffing texture in opposite directions.

It is also contemplated that cutter bundles 32 may be applied to the pallet surfaces to create multi-directional surface scuffing. As shown in the simplified schematic illustration of FIG. 7, apparatus 30' includes cutter bundles 32 and 32" are oriented in a perpendicular relation to each other, such that cutter bundle 32 is applied to surface 12, and then cutter bundle 32" takes a subsequent pass on surface 12, thereby shearing the surface in a plurality of directions and improving the slip resistance of the surface in a plurality of directions. Of course, while the cutter bundles 32 are shown as oriented in a perpendicular manner, they may be oriented in any number of orientations to define the multi-directional slip resistance to the pallet surface.

The cutter bundles 32 may be moved past the pallet surface, or preferably, the cutter bundles are fixed in position and relative movement between the cutter bundles and the pallet 10 may be accomplished by a carriage, i.e. a moving belt or series of links on which the pallets are placed or mounted. Any conventional means of producing relative movement of the cutter bundles and the pallet may be used.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of producing slip resistant surfaces on a plastic pallet comprising:

a) providing a plastic pallet having at least one contacting surface;

b) contacting the at least one contacting surface with at least one cutter bundle having a plurality of cutting members with radial toothed edges;

c) rotating the at least one cutter bundle with a drive shaft; and d) moving the at least one contacting surface relative to the least one cutter bundle, such that the at least one contacting surface is scuffed by the plurality of cutting members.

2. The method of claim 1, wherein said step c) includes rotating a plurality of cutter bundles about parallel axes.

3. The method of claim 2, wherein said step c) includes orienting at least one of the plurality of cutter bundles offset from the remaining of the plurality of cutter bundles such that during rotation they form parallel scuffing patterns along the at least one contacting surface.

4. The method of claim 1, wherein said step d) includes moving the at least one contacting surface with a carriage portion of a conveying device on which the at least one contacting surface is conveyed.

5. The method of claim 1, wherein said at least one cutter bundle includes a plurality of cutter bundles, said step c) includes rotating at least one of the plurality of cutter bundles in a first direction and rotating the remaining of the plurality of cutter bundles in an opposing direction.

6. The method of claim 1, wherein said step a) includes providing at least one of an outer load bearing surface and a fork-lift contactable surface as the at least one contacting surface, and locating the at least one contacting surface proximate an axis of rotation of the at least one cutter bundle.

7. The method of claim 1, wherein said step a) includes providing at least one of an outer load bearing surface and a fork-lift contactable surface as the at least one contacting surface, and locating the at least one contacting surface proximate an axis of rotation of at least one cutter bundle.

8. The method of claim 1, wherein said step a) includes assembling an upper deck to the plastic pallet prior to contact of the at least one contacting surface with the plurality of cutting members.

9. The method of claim 1, wherein said step b) includes contacting an upper deck with the plurality of cutting members, and thereafter assembling the upper deck with other plastic members to form the plastic pallet.

10. The method of claim 1, wherein b) includes contacting an outward facing load bearing surface of an upper deck and an inward facing fork-lift-contactable surface of the upper deck, and thereafter assembling the upper deck with other plastic members to form the plastic pallet.

* * * * *